US008454733B2

(12) United States Patent
Tanaka et al.

(10) Patent No.: US 8,454,733 B2
(45) Date of Patent: Jun. 4, 2013

(54) AIR HANDLING DEVICE

(75) Inventors: Toshio Tanaka, Osaka (JP); Shunji Haruna, Osaka (JP); Kanji Motegi, Osaka (JP); Ryuji Akiyama, Osaka (JP)

(73) Assignee: Daikin Industries, Ltd., Osaka-Shi (JP)

( * ) Notice: Subject to any disclaimer, the term of this patent is extended or adjusted under 35 U.S.C. 154(b) by 477 days.

(21) Appl. No.: 12/740,263

(22) PCT Filed: Oct. 8, 2008

(86) PCT No.: PCT/JP2008/002841

§ 371 (c)(1),
(2), (4) Date: Apr. 28, 2010

(87) PCT Pub. No.: WO2009/057251

PCT Pub. Date: May 7, 2009

(65) Prior Publication Data

US 2010/0251894 A1 Oct. 7, 2010

(30) Foreign Application Priority Data

Oct. 29, 2007 (JP) ..... 2007-279972

(51) Int. Cl.
*B03C 3/12* (2006.01)

(52) U.S. Cl.
USPC ..... 96/77; 96/97

(58) Field of Classification Search
USPC ..... 96/77–79, 97; 95/79; 361/225–235
See application file for complete search history.

(56) References Cited

U.S. PATENT DOCUMENTS

| | | | | | |
|---|---|---|---|---|---|
| 3,803,808 | A | | 4/1974 | Shibuya et al. | |
| 4,018,577 | A | * | 4/1977 | Shibuya et al. | 96/78 |
| 4,265,641 | A | * | 5/1981 | Natarajan | 95/79 |
| 4,643,745 | A | * | 2/1987 | Sakakibara et al. | 96/76 |
| 4,713,092 | A | * | 12/1987 | Kikuchi et al. | 96/70 |
| 5,466,279 | A | * | 11/1995 | Hattori et al. | 96/69 |
| 5,547,496 | A | * | 8/1996 | Hara | 96/79 |
| 5,733,360 | A | * | 3/1998 | Feldman et al. | 95/78 |
| 6,004,376 | A | * | 12/1999 | Frank | 95/79 |
| 6,251,171 | B1 | * | 6/2001 | Marra et al. | 96/69 |
| 6,932,857 | B1 | * | 8/2005 | Krigmont | 95/63 |
| 7,019,244 | B2 | * | 3/2006 | Weaver et al. | 209/127.1 |
| 2006/0016337 | A1 | * | 1/2006 | Taylor et al. | 96/25 |

FOREIGN PATENT DOCUMENTS

| | | | | | |
|---|---|---|---|---|---|
| CN | 1541774 | A | | 11/2004 | |
| JP | 49-83969 | A | | 8/1974 | |
| JP | 49-111885 | U | | 9/1974 | |
| JP | 49-111280 | A | | 10/1974 | |
| JP | 51-56068 | A | | 5/1976 | |
| JP | 54-136476 | A | * | 10/1979 | 96/79 |

(Continued)

OTHER PUBLICATIONS

Partial English translation of JP-2001-286786-A dated Oct. 16, 2001.

*Primary Examiner* — Richard L Chiesa
(74) *Attorney, Agent, or Firm* — Birch, Stewart, Kolasch & Birch, LLP

(57) ABSTRACT

An air handling device (10) includes an air flow path (13) in which a charge section (20) for charging dust in an air to be handled, and a precipitator (30) for collecting the charged dust are placed. The charge section (20) includes a discharge electrode (25) and a counter electrode (26) to perform diffusion charging. A diffusion space (13*a*) is provided at a location between the charge section (20) and the precipitator (30).

19 Claims, 8 Drawing Sheets

FOREIGN PATENT DOCUMENTS

| | | | |
|---|---|---|---|
| JP | 60-153958 | A | 8/1985 |
| JP | 1-194922 | A | 8/1989 |
| JP | 2001-286786 | A | 10/2001 |
| JP | 2006-116492 | A | 5/2006 |

* cited by examiner

AIR HANDLING DEVICE

TECHNICAL FIELD

The present invention relates to air handling devices in which dust in the air to be handled is charged and collected, and specifically relates to techniques of enhancing duct collection efficiency.

BACKGROUND ART

Patent Document 1 shows, as a conventional air handling device, an air cleaning device in which a charging unit having a charge section is detachable from the body having a precipitator. According to this air cleaning device, ions generated at the charging unit are dispersed in a room and brought into contact with the dust suspended in the air, and thereby the dust is charged. This dust is drawn into the body of the air cleaning device by a fan, and is collected at the precipitator.

CITATION LIST

Patent Document

Patent Document 1: Japanese Patent Publication No. 2006-116492

SUMMARY OF THE INVENTION

Technical Problem

However, according to the device in Patent Document 1, the dust is ionized in a room. Therefore, dust may adhere to the walls before the dust is taken into the precipitator, and the walls may become soiled. This is because the dust collection efficiency is low.

In addition, it is impossible to draw all the charged dust into the casing according to the technique shown in Patent Document 1 in which dust is charged by ions dispersed in a room. This means that the dust collection efficiency is low, and that sufficient capability for collecting dust may not be obtained.

The present invention was made in view of the above problems, and it is an objective of the invention to avoid soiling of a room and obtain sufficient dust collection capability, by enhancing dust collection efficiency in an air handling device adopting a technique in which ions generated at a charge section are dispersed.

Solution to the Problem

The first aspect of the present invention is intended for an air handling device having an air flow path (13) in which a charge section (20) for charging dust in an air to be handled, and a precipitator (30) for collecting the charged dust are placed.

The air handling device is configured such that the charge section (20) includes a discharge electrode (25) and a counter electrode (26) to perform diffusion charging, and a diffusion space (13*a*) is provided at a location between the charge section (20) and the precipitator (30).

According to the first aspect of the present invention, ions generated between the discharge electrode (25) and the counter electrodes (26) of the charge section (20) are diffused in the diffusion space (13*a*) and combined with dust in the air to be handled, and thereby, the dust is charged. Dust and ions are mixed in the diffusion space (13*a*). This allows efficient charging of the dust.

The second aspect of the present invention according to the first aspect of the present invention is that a diffusion member (13*b*) for diffusing ions in an air is provided in the diffusion space (13*a*).

According to the second aspect of the present invention, ions and dust flow in parallel when the air passes through the diffusion member (13*b*) in the diffusion space (13*a*). Therefore, the ions and the dust are mixed when the air passes through the diffusion member (13*b*) in the diffusion space (13*a*), and the dust are efficiently charged.

The third aspect of the present invention according to the first or the second aspect of the present invention is that a bent path is provided in a space through which the air flows after having passed the charge section (20) and before passing through the precipitator (30).

According to the third aspect of the present invention, the air having passed through the charge section (20) passes through a bent path before the air reaches the precipitator (30). Ions and dust are stirred and mixed, and thereby, the dust is efficiently charged.

The fourth aspect of the present invention according to the first aspect of the present invention is that an airflow speed of the air to be handled is higher when the air passes through the charge section (20) than when the air passes through a main portion of the air flow path (13).

According to the fourth aspect of the present invention, the airflow speed of the air to be handled is high when the air passes through the charge section (20). Therefore, the amount of diffusion of ions increases. Here, the dust collection efficiency decreases as the speed of the air passing through the precipitator (30) increases. However, the precipitator (30) is placed in the main portion through which the air passes at a low speed, and therefore, the dust can be collected efficiently.

The fifth aspect of the present invention according to the fourth aspect of the present invention is that the air handling device includes a flow path control member (35) which makes the airflow speed of the air to be handled higher when the air passes through the charge section (20) than when the air passes through the main portion of the air flow path (13).

According to the fifth aspect of the present invention, the air flow speed of the air to be handled is high when the air passes through the charge section (20), and a turbulent flow occurs when the air passes through the charge section (20). Consequently, the amount of diffusion of ions increases. Here, the dust collection efficiency decreases as the speed of the air passing through the precipitator (30) increases. However, the precipitator (30) is placed in the main portion through which the air passes at a low speed, and therefore, the dust can be collected efficiently.

The sixth aspect of the present invention according to the fourth aspect of the present invention is that an opening area of an air inlet (12*a*) of the air flow path (13) is smaller than an opening area of the main portion of the air flow path (13), and the charge section (20) is provided at the air inlet (12*a*).

According to the sixth aspect of the present invention, the air to be handled passes through the charge section (20) at a high speed, and the length of the diffusion space (13*a*) is the longest. Therefore, the amount of diffusion of ions increases. Here, the dust collection efficiency decreases as the speed of the air passing through the precipitator (30) increases. However, the precipitator (30) is placed in the main portion through which the air passes at a low speed, and therefore, the dust can be collected efficiently.

The seventh aspect of the present invention according to any one of the first to the sixth aspects of the present invention is that the air inlet (12*a*) of the air flow path (13) is provided in a side surface of the air flow path (13).

According to the seventh aspect of the present invention, the air inlet (12*a*) is provided in a side face of the air flow path (13). Thus, the flow of the air drawn into the air flow path (13) through the air inlet (12*a*) is bent. This means that if the charge section (20) is provided at a location close to the air inlet (12*a*), ions are diffused when the flow of the air is bent, and consequently, diffusion efficiency can be increased. As a result, ions and dust can be easily combined with each other, and the dust collection efficiency can be enhanced.

The eighth aspect of the present invention according to any one of the first to the seventh aspects of the present invention is that the precipitator (30) is a member which electrostatically collects dust.

According to the eighth aspect of the present invention, dust having passed through the charge section (20) is combined with ions in the diffusion space (13*a*), and the charged dust is collected at the electrostatic precipitator (30) by a coulomb force. This can improve the dust collection efficiency.

The ninth aspect of the present invention according to any one of the first to the eighth aspects of the present invention is that if an electric current flowing in the discharge electrode (25) is represented by I1 and an electric current flowing in the counter electrode (26) is represented by I2, an diffusion charging current (I1-I2) flows in both of the electrodes.

According to the ninth aspect of the present invention, if the current flowing in the counter electrode (26) is smaller than the current flowing in the discharge electrode (25), a difference between the current flowing in the counter electrode (26) and the current flowing in the discharge electrode (25) is a diffusion charging current (I1-I2) at the charge section (20). In other words, the existence of the diffusion charging current means that the diffusion charging is occurring.

The tenth aspect of the present invention according to any one of the first to the ninth aspects of the present invention is that the discharge electrode (25) is a needle-like electrode.

According to the tenth aspect of the present invention, a needle-like electrode is used for the discharge electrode (25) of the charge section (20) adopting a diffusion charging technique. Consequently, the electric field concentrates at the tips of the discharge electrode (25), and as a result, ions are emitted more easily.

The eleventh aspect of the present invention according to any one of the first to the ninth aspects of the present invention is that the discharge electrode (25) is a sawtooth electrode.

According to the eleventh aspect of the present invention, a sawtooth electrode is used for the discharge electrode (25) of the charge section (20) adopting a diffusion charging technique. The sawtooth electrode may be sharp-tipped, like a shape of a needle-like electrode, and therefore, the electric field concentrates at the tips of the discharge electrode (25). Consequently, ions tend to be emitted more easily.

The twelfth aspect of the present invention according to the tenth or the eleventh aspect of the present invention is that the counter electrode (26) is positioned at a location shifted from a discharge direction of the discharge electrode (25).

According to the twelfth aspect of the present invention, the counter electrode (26) is positioned at a location shifted from a direction along which ions are emitted from the discharge electrode (25) of the charge section (20). This structure reduces the likelihood of the ions reaching the counter electrode (26). Therefore, the ions can be easily diffused in the air.

The thirteenth aspect of the present invention according to any one of the first to the twelfth aspects of the present invention is that the first charge section (20*a*) adopting an impact charging technique is positioned on an upstream side of a flow direction of the air to be handled, and the second charge section (20*b*) adopting a diffusion charging technique is positioned on a downstream side of the flow direction of the air to be handled.

According to the thirteenth aspect of the present invention, the air to be handled passes through the first charge section (20*a*) first, and then, passes through the second charge section (20*b*). Here, a comparison between the first charge section (20*a*) adopting an impact charging technique and the second charge section (20*b*) adopting a diffusion charging technique shows that if a charging time is short, the amount of charge by the impact charging technique is larger than the amount of charge by the diffusion charging technique, and in contrast, if the charging time is long, the amount of charge by the diffusion charging technique is larger than the amount of charge by the impact charging technique. Thus, using the impact charging technique on the upstream side of an air flow and the diffusion charging technique on the downstream side of the air flow results in obtaining sufficient amount of charge relatively easily.

The fourteenth aspect of the present invention according to the thirteenth aspect of the present invention is that a discharge electrode (25) of the first charge section (20*a*) and a discharge electrode (25) of the second charge section (20*b*) are constituted by an integral discharge electrode (25); and a counter electrode (26) of the first charge section (20*a*) is located on the air flow upstream side with respect to the discharge electrode (25), and a counter electrode (26) of the second charge section (20*b*) is located on the air flow downstream side, relative to the discharge electrode (25).

According to the fourteenth aspect of the present invention, a discharge electrode (25) of the first charge section (20*a*) and a discharge electrode (25) of the second charge section (20*b*) are integrally formed with each other, and the first charge section (20*a*) is located on the air flow upstream side of the second charge section (20*b*). Thus, it is possible to simplify the structure of the discharge electrode (25), and possible to obtain a sufficient amount of charge.

The fifteenth aspect of the present invention according to the fourteenth aspect of the present invention is that the integral discharge electrode (25) includes a first discharge section (25*a*) which constitutes the discharge electrode (25) of the first charge section (20*a*), and a second discharge section (25*b*) which constitutes the discharge electrode (25) of the second charge section (20*b*); and the counter electrode (26) of the first charge section (20*a*) and the counter electrode (26) of the second charge section (20*b*) are constituted by an integral counter electrode (26), and the integral counter electrode (26) is located closer to the first discharge section (25*a*) than to the second discharge section (25*b*).

According to the fifteenth aspect of the present invention, counter electrodes (26) are integrally formed with each other, and the integral counter electrode (26) is located close to the first discharge section (25*a*) which is placed on the upstream side of the second discharge section (25*b*) placed on a downstream side of the flow direction of the air to be handled. The structure can thus be simplified. In addition, an impact charging tends to occur between the first discharge section (25*a*) and the counter electrode (26), and a diffusion charging tends to occur between the second discharge section (25*b*) and the counter electrode (26).

The sixteenth aspect of the present invention according to any one of the first to the fifteenth aspects of the present invention is that the counter electrode (26) of the charge section (20) which performs diffusion charging is a rod-like electrode having a polygonal cross section and obtuse-angled corners.

The seventeenth aspect of the present invention according to any one of the first to the fifteenth aspects of the present invention is that the counter electrode (26) of the charge section (20) which performs diffusion charging is a rod-like electrode having a circular cross section.

According to the sixteenth and the seventeenth aspects of the present invention, the electric field does not concentrate at the edges of the counter electrode (26). Thus, ions tend to be diffused relatively easily.

The eighteenth aspect of the present invention according to the sixteen or the seventeenth aspect of the present invention is that a diagonal dimension or a diameter of the counter electrode (26) of the charge section (20) which performs diffusion charging is one fifth or less of a distance between the discharge electrode (25) and the counter electrode (26), and is greater than zero (mm).

According to the eighteenth aspect of the present invention, the diameter or the diagonal dimension of the counter electrode (26) is small enough, compared to the distance between the discharge electrode (25) and the counter electrode (26). This means that the surface area of the counter electrode (26) is reduced, and therefore, it is possible to reduce absorption of ions.

The nineteenth aspect of the present invention according to any one of the sixteenth to the eighteenth aspects of the present invention is that a space (S1) is provided in a region opposite to the discharge electrode (25), relative to the counter electrode (26) of the charge section (20) which performs diffusion charging.

According to the nineteenth aspect of the present invention, electric force lines which curve and reach a space behind the counter electrode (26) (a space (S1) opposite to the discharge electrode (25)) are generated between the discharge electrode (25) and the counter electrode (26). Ions tend to be absorbed into the counter electrode (26) if emitted along a linear electric force line generated between the discharge electrode (25) and the counter electrode (26). On the other hand, ions tend not to be absorbed into the counter electrode (26) if emitted along an electric force line which curves and reaches the space behind the counter electrode (26). Therefore, diffusion components of the ions are generated in the space (S1), in which diffusion charging occurs.

The twentieth aspect of the present invention according to any one of the sixteenth to the eighteenth aspects of the present invention is that a space (S1) is provided around an entire periphery of the counter electrode (26) of the charge section (20) which performs diffusion charging.

According to the twentieth aspect of the present invention, electric force lines which curve and reach the space behind the counter electrode (26) are generated as well, as in the nineteenth aspect of the present invention. Therefore, diffusion components of the ions are generated in the space (S1), in which diffusion charging occurs.

The twenty-first aspect of the present invention according to the nineteenth or the twentieth aspect of the present invention is that the counter electrode (26) of the charge section (20) which performs diffusion charging is located in an air flow path along which the air to be handled flows.

According to the twenty-first aspect of the present invention, the counter electrode (26) of the second charge section (20*b*) is located in an air flow path along which the air to be handled flows. Thus, ions which have been emitted from the discharge electrode (25) of the second charge section (20*b*) and which are supposed to be injected to the counter electrode (26) are affected by the air flow, and are diffused in the air without being incident into the counter electrode (26).

ADVANTAGES OF THE INVENTION

According to the present invention, the charge section (20) includes the discharge electrode (25) and the counter electrode (26) for performing diffusion charging, and the diffusion space (13*a*) is provided between the charge section (20) and the precipitator (30). Thus, ions generated between the discharge electrode (25) and the counter electrodes (26) of the charge section (20) are diffused in the diffusion space (13*a*) and combined with dust in the air to be handled, and thereby, the dust is charged. Dust and ions are mixed in the diffusion space (13*a*), which allows efficient charging of the dust. Therefore, sufficient capabilities for collecting dust can be obtained. Further, dust is charged and collected in the device. Consequently, soiling of walls of a room can be prevented.

According to the second aspect of the present invention, the diffusion member (13*b*) for regulating the direction of air flow is provided in the diffusion space (13*a*). Thus, ions are diffused in the air when the air passes through the diffusion member (13*b*) in the diffusion space (13*a*), and at this time, dust is mixed with the ions and is efficiently charged. Consequently, capabilities for collecting dust of the air handling device can be increased. In this structure, too, ions are not released outside the device, and therefore, soiling of a room can be prevented.

According to the third aspect of the present invention, the air having passed through the charge section (20) passes through a bent path before the air reaches the precipitator (30). Ions and dust are stirred and mixed at this time, and thereby, the dust is efficiently charged. As a result, the capabilities for collecting dust of the device can be increased, and soiling of a room can be prevented because ions are not released outside the device.

According to the fourth aspect of the present invention, the airflow speed of the air to be handled is high when the air passes through the charge section (20). Therefore, the amount of diffusion of ions increases. Here, the dust collection efficiency decreases as the speed of the air passing through the precipitator (30) increases. However, the precipitator (30) is placed in the main portion through which the air passes at a low speed. Since the air flow speed for both of the charge section (20) and the main portion is optimized, the dust can be collected efficiently in a compact structure.

According to the fifth aspect of the present invention, the flow speed of the air to be handled is high when the air passes through the charge section (20), and a turbulent flow occurs when the air passes through the charge section (20). Consequently, the amount of diffusion of ions increases. Here, the dust collection efficiency decreases as the speed of the air passing through the precipitator (30) increases. However, the precipitator (30) is placed in the main portion through which the air passes at a low speed. Since the air flow speed for both of the charge section (20) and the main portion is optimized, the dust can be collected efficiently in a compact structure.

According to the sixth aspect of the present invention, the air to be handled passes through the charge section (20) at a high speed, and the length of the diffusion space (13*a*) is the longest. Therefore, the amount of diffusion of ions increases. Here, the dust collection efficiency decreases as the speed of the air passing through the precipitator (30) increases. However, the precipitator (30) is placed in the main portion through which the air passes at a low speed. Since the air flow speed for both of the charge section (20) and the main portion is optimized, the dust can be collected efficiently in a compact structure.

According to the seventh aspect of the present invention, the air inlet (12*a*) is provided in the side face of the air flow path (13). Thus, the flow of the air drawn into the air flow path (13) through the air inlet (12*a*) is bent. This means that if the charge section (20) is provided at a location close to the air inlet (12*a*), ions are diffused when the flow of the air is bent, and consequently, diffusion efficiency can be increased. As a result, ions and dust can be easily combined with each other, and the dust collection efficiency can be enhanced.

According to the eighth aspect of the present invention, dust having passed through the charge section (20) is combined with ions in the diffusion space (13*a*), and the charged dust is collected at the electrostatic precipitator (30) by a coulomb force. This can improve the dust collection efficiency.

According to the ninth aspect of the present invention, if the current flowing in the counter electrode (26) is smaller than the current flowing in the discharge electrode (25), a difference between the current flowing in the counter electrode (26) and the current flowing in the discharge electrode (25) is a diffusion charging current (I1-I2) at the charge section (20). In other words, the existence of the diffusion charging current means that the diffusion charging is occurring.

According to the tenth aspect of the present invention, a needle-like electrode is used for the discharge electrode (25) of the charge section (20) adopting a diffusion charging technique. Consequently, the electric field concentrates at the tips of the discharge electrode (25), and as a result, ions are emitted more easily. This can enhance discharge efficiency of the charge section (20), and as a result, the size of the device can be reduced.

According to the eleventh aspect of the present invention, a sawtooth electrode is used for the discharge electrode (25) of the charge section (20) adopting a diffusion charging technique. The sawtooth electrode is sharp-tipped, like a shape of a needle-like electrode, and therefore, the electric field concentrates at the tips of the discharge electrode (25). Consequently, ions tend to be emitted more easily. This can enhance discharge efficiency of the charge section (20), and as a result, the size of the device can be reduced.

According to the twelfth aspect of the present invention, the counter electrode (26) is positioned at a location shifted from a direction along which ions are emitted from the discharge electrode (25) of the charge section (20). This structure reduces the likelihood of the ions reaching the counter electrode (26). Therefore, the ions can be easily diffused in the air. That is, absorption of ions at the counter electrode (26) can be reduced, and diffusion components of all the discharged ions can be increased.

According to the thirteenth aspect of the present invention, the first charge section (20*a*) is positioned on an upstream side of a direction of the air to be handled, and the second charge section (20*b*) is positioned on a downstream side of the direction of the air to be handled. Thus, the air to be handled passes through the first charge section (20*a*) first, and then, passes through the second charge section (20*b*). Here, a comparison between the first charge section (20*a*) adopting an impact charging technique and the second charge section (20*b*) adopting a diffusion charging technique shows that if a charging time is short, the amount of charge by the impact charging technique is larger than the amount of charge by the diffusion charging technique, and in contrast, if the charging time is long, the amount of charge by the diffusion charging technique is larger than the amount of charge by the impact charging technique. Thus, using the impact charging technique on the upstream side of an air flow and the diffusion charging technique on the downstream side of the air flow results in obtaining sufficient amount of charge relatively easily. Consequently, efficiency of the charge section (20) as a whole can be enhanced.

According to the fourteenth aspect of the present invention, a discharge electrode (25) of the first charge section (20*a*) and a discharge electrode (25) of the second charge section (20*b*) are integrally formed with each other, and the first charge section (20*a*) is located on the air flow upstream side of the second charge section (20*b*). Thus, it is possible to simplify the structure of the discharge electrode (25), and possible to obtain a sufficient amount of charge. Consequently, efficiency of the charge section (20) as a whole can be enhanced.

According to the fifteenth aspect of the present invention, counter electrodes (26) are integrally formed with each other, and the integral counter electrode (26) is located close to the first discharge section (25*a*) which is placed on the upstream side of the second discharge section (25*b*) placed on the downstream side of the direction of the air to be handled. The structure can thus be simplified. In addition, an impact charging tends to occur between the first discharge section (25*a*) placed on the upstream side and the counter electrode (26), and a diffusion charging tends to occur between the second discharge section (25*b*) placed on the downstream side and the counter electrode (26). Consequently, efficiency of the charge section (20) as a whole can be enhanced.

According to the sixteenth and the seventeenth aspects of the present invention, the counter electrode (26) of the second charge section (20*b*) is a rod-like electrode having a polygonal cross section and obtuse-angled corners, or a rod-like electrode having a circular cross section. Thus, the electric field does not concentrate at the edges of the counter electrode (26), and ions tend to be diffused easily. Consequently, efficiency of diffusion charging improves.

According to the eighteenth aspect of the present invention, the diameter or the diagonal dimension of the counter electrode (26) is small enough, compared to the distance between the discharge electrode (25) and the counter electrode (26). This means that the surface area of the counter electrode (26) is reduced, and therefore, it is possible to reduce absorption of ions. As a result, diffusion components of all the ions generated at the second charge section (20*b*) can be increased, and therefore, particles of submicron-order (less than 1 nm) can be efficiently charged.

According to the nineteenth aspect of the present invention, electric force lines which curve and reach the space behind the counter electrode (26) (a space (S1) opposite to the discharge electrode (25)) are generated between the discharge electrode (25) and the counter electrode (26). Ions tend to be absorbed into the counter electrode (26) if emitted along a linear electric force line generated between the discharge electrode (25) and the counter electrode (26). On the other hand, ions tend not to be absorbed into the counter electrode (26) if emitted along an electric force line which curves and reaches the space behind the counter electrode (26). Therefore, diffusion components of the ions are generated in the space (S1), in which diffusion charging occurs. Consequently, efficiency of diffusion charging improves.

According to the twentieth aspect of the present invention, electric force lines which curve and reach the space behind the counter electrode (26) are generated as well, as in the nineteenth aspect of the present invention. Therefore, diffusion components of the ions are generated in the space (S1), in which diffusion charging occurs. Consequently, efficiency of diffusion charging improves.

According to the twenty-first aspect of the present invention, the counter electrode (26) of the second charge section (20*b*) is located in an air flow path along which the air to be handled flows. Thus, ions which have been emitted from the discharge electrode (25) of the second charge section (20*b*) and which are supposed to be injected to the counter electrode (26) are affected by the air flow, and are diffused in the air without being incident into the counter electrode (26). This means that diffusion components of the ions are increased, and consequently, efficiency of diffusion charging improves.

DESCRIPTION OF REFERENCE CHARACTERS

10 Air Cleaning Device (Air Handling Device)
12*a* Air Inlet
13 Air Flow Path
13*a* Diffusion Space
13*b* Diffusion Member
20 Charge Section
20*a* First Charge Section
20*b* Second Charge Section
25 Discharge Electrode
25*a* Upstream Discharge Section (First Discharge Section)
25*b* Downstream Discharge Section (Second Discharge Section)
26 Counter Electrode
30 Precipitator
35 Flow Path Control Member
S1 Space

DESCRIPTION OF EMBODIMENTS

Embodiments of the present invention will be described in detail hereinafter, with reference to the drawings.

<<First Embodiment of Invention>>

The first embodiment of the present invention will be described.

Figure 1:
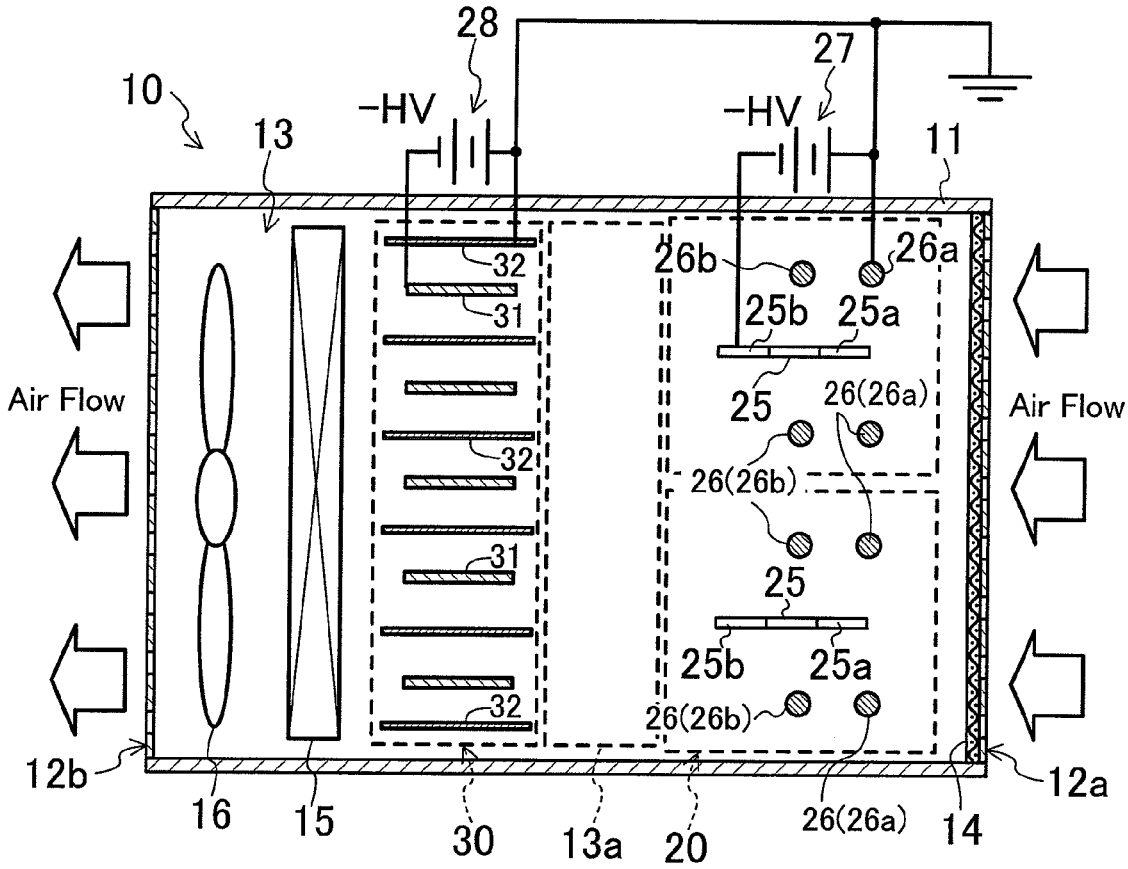
FIG. 1 shows a schematic cross-sectional view of an interior structure of an air cleaning device according to the first embodiment of the present invention.

The first embodiment relates to an air cleaning device (10) serving as an air handling device according to the present invention. FIG. 1 is a schematic cross-sectional view of an interior structure of the air cleaning device (10).

The air cleaning device (10) has a hollow casing (11) whose shape is a rectangular parallelepiped. A plurality of functional components are accommodated in the casing (11). An air inlet (12*a*) is provided in one wall of the casing (11). An air outlet (12*b*) is provided in the wall facing the air inlet (12*a*). The air inlet (12*a*) is provided with a pre-filter (14) for collecting relatively large dust (floating particles) contained in the air to be handled.

An air flow path (13) through which air flows from the air inlet (12*a*) to the air outlet (12*b*) is formed in the interior of the casing (11). A charge section (20), a precipitator (30), an adsorption member (15) and a propeller fan (16) are disposed in the air flow path (13), in this order, from the upstream side to the downstream side of an air flow. A diffusion space (13*a*) for diffusing ions generated at the charge section (20) is formed between the charge section (20) and the precipitator (30).

Figure 2:
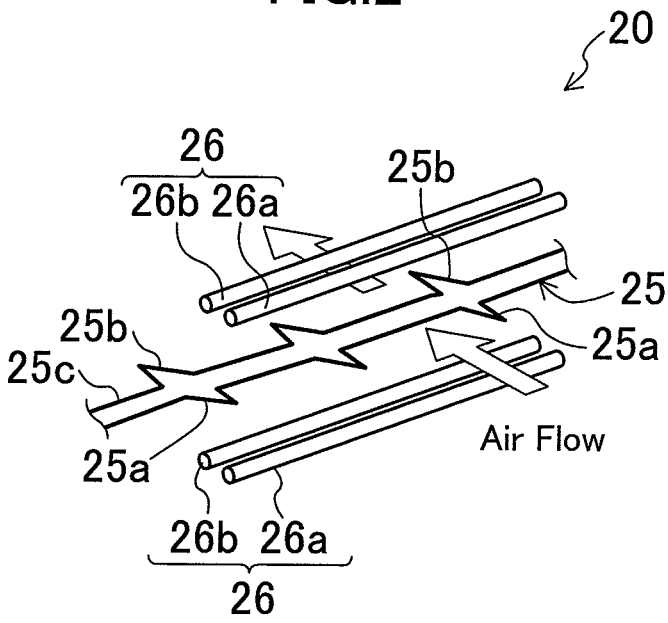
FIG. 2 shows an oblique view of a structure of a charge section according to the first embodiment.
Figure 3:
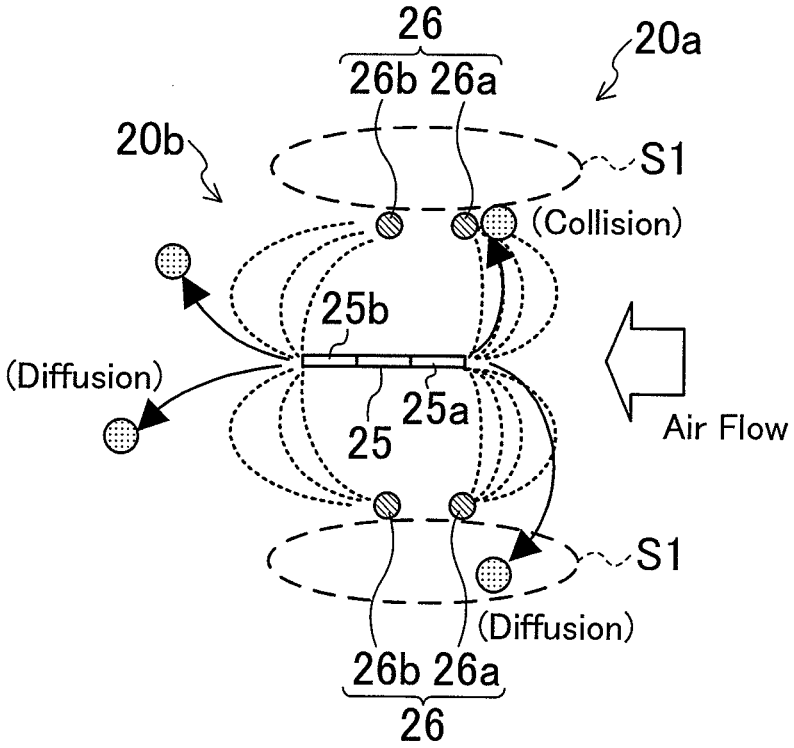
FIG. 3 shows a side view of a structure of the charge section according to the first embodiment.

The air cleaning device (10) has two charge sections (20) having the same structure and arranged one above the other. Each charge section (20) is constituted by a discharge electrode (25) and counter electrodes (26), as shown in FIGS. 2 and 3.

The discharge electrode (25) is a strip-like electrode arranged parallel to the direction of air flow, and having triangular projections (25*a*, 25*b*), whose tip has an acute angle (the tip may be rounded with a small radius), at both edges of the discharge electrode (25) at generally regular intervals. These projections (25*a*, 25*b*) constitute a discharge section. As described, the discharge electrode (25) provided at the charge section (20) is a sawtooth electrode. The charge section includes an upstream discharge section (25*a*) (a discharge electrode (25) of a first charge section (20*a*), described later) located on the upstream side of an air flow, and a downstream discharge section (25*b*) (a discharge electrode (25) of a second charge section (20*b*), described later) located on the downstream side of the air flow.

The counter electrodes (26) are rod-like electrodes (or columnar electrodes), and arranged such that the discharge electrode (25) is interposed between two pairs of counter electrodes located above and below the discharge electrode (25). Each pair of counter electrodes (26) includes a counter electrode (an upstream counter electrode) (26*a*) located on the upstream side of an air flow, and a counter electrode (downstream counter electrode) (26*b*) located on the downstream side of the air flow. The upstream counter electrodes (26*a*) are arranged parallel to the discharge electrode (25) along a vertically-extending phantom plane which passes through the tip, or an area close to the tip of the upstream discharge section (25*a*). Further, the downstream counter electrodes (26*b*) are arranged parallel to the discharge electrode (25) along a vertically-extending phantom plane which passes through a center line, or an area close to the center line of the discharge electrode (25).

A negative pole of a direct current high voltage power supply (27) for discharge is connected to the discharge electrode (25), and a positive pole of the power supply (27) is connected to the counter electrodes (26). The positive side of the high voltage power supply (27) is grounded.

Not only a diffusion charging technique, but also an impact charging technique are used for the charge section (20) in this embodiment. The upstream discharge section (25*a*) and the upstream counter electrodes (26*a*) constitute a first charge section (20*a*) adopting an impact charging technique. The downstream discharge section (25*b*) and the downstream counter electrodes (26*b*) constitute a second charge section (20*b*) adopting a diffusion charging technique. That is, if described with reference to the direction of flow of the air to be handled, the first charge section (20*a*) is positioned on the upstream side of the air flow, and the second charge section (20*b*) is positioned on the downstream side of the air flow. This means that the counter electrodes (26) of the first charge section (20*a*) are located on the air flow upstream side, and the counter electrodes (26) of the second charge section (20*b*) are located on the air flow downstream side, relative to the discharge electrode (25).

In this structure, the entire charge section (20) including the counter electrodes (26) (upstream counter electrodes (26*a*)) of the first charge section (20*a*) and the counter electrodes (26) (downstream counter electrodes (26*b*)) of the second charge section (20*b*), is located in an air flow path (13) along which the air to be handled flows. It is preferable that at least the counter electrodes (26) of the second charge section (20*b*) are located in the air flow path (13) through which the air to be handled passes.

In the first charge section (20*a*), the upstream discharge section (25*a*) and the upstream counter electrodes (26*a*) are located generally along the same plane, and therefore, the degree of curvature of the electric force lines generated between the upstream discharge section (25*a*) and the upstream counter electrodes (26*a*) is small as shown in FIG. 3. In contrast, in the second charge section (20*b*), the downstream counter electrodes (26*b*) are positioned at locations shifted from the direction of ion emission from the downstream discharge section (25*b*), and thus, the degree of curvature of the electric force lines generated between the downstream discharge section (25*b*) and the downstream counter electrodes (26*b*) is large.

The diffusion space (13*a*) is a space for discharging ions released in the air because of discharge between the downstream discharge section (25*b*) and the downstream counter electrodes (26*b*) of the charge section (20). In this diffusion space (13*a*) the ions are combined with dust in the air.

The precipitator (30) includes a first electrode (31) to which a negative pole of a direct current high voltage power supply (28) for collecting dust is connected, and a second electrode (32) to which a positive pole of the power supply (28) is connected. The positive side of the power supply (28) is grounded. The first electrode (31) and the second electrode (32) may be plate electrodes alternately arranged at equal intervals, or the second electrode (32) may be in the form of grid, with the rod-like, or needle-like first electrode (31) being disposed in the small space of each grid cell.

The adsorption member (15) is a member which includes a honeycomb base having a lot of small air flow holes along the direction of an air flow, and in which fine powders of an adsorption, such as zeolite which adsorbs odorous components, are carried on the surface of the honeycomb base. Not only an adsorption, but also fine powders of a deodorizing catalyst are carried on the adsorption member (15). If part of odorous components in the air passes through the precipitator (30) without being captured by the precipitator (30), the adsorption member (15) captures the odorous components with the adsorption, and decomposes the odorous components on the surface of the adsorption member (15) by the action of the deodorizing catalyst. Heat catalysts and photocatalysts which are activated by active substances such as heat, light, ozone and so forth generated by the discharge in the charge section (20), and which accelerate the decomposition of the odorous components, can be used as the deodorizing catalyst.

—Operational Behavior—

When the air cleaning device (10) according to the present embodiment is actuated, the propeller fan (16) rotates, and room air, i.e., air to be handled, is drawn into the casing (11) through the air inlet (12*a*). In the charge section (20), a potential difference is established between the discharge electrode (25) and the counter electrodes (26), and ions are emitted from the discharge electrode (25). Most of the ions emitted from the upstream discharge section (25*a*) of the discharge electrode (25) reach the upstream counter electrodes (26*a*), whereas most of the ions emitted from the downstream discharge section (25*b*) does not reach the downstream counter electrodes (26*b*) and is released in the air.

One of the characteristics of the impact charging technique is that relatively large dust (floating particles) of micron-order (1 μm or more) tend to be charged in the impact charging technique, and one of the characteristics of the diffusion charging technique is that relatively small dust of submicron-order (less than 1 μm) tend to be charged in the diffusion charging technique. The first charge section (20*a*) adopts an impact charging technique, and most of the ions emitted from the upstream discharge section (25*a*) reach the counter electrodes (26). The ions are gathered at an area between the upstream discharge section (25*a*) and the upstream counter electrodes (26*a*). The relatively large dust of micron-order is charged when the air to be handled passes through this area. In contrast, the second charge section (20*b*) adopts a diffusion charging technique, and most of the ions emitted from the downstream discharge section (25*b*) is released in the air of the diffusion space (13*a*). Thus, the ions are dispersed in the air, and the relatively small dust of submicron-order is charged when the air to be handled flows through the diffusion space (13*a*).

The air to be handled flows into the precipitator (30), with dust particles, ranging from small to large dust particles, being charged. Since the precipitator (30) includes the negatively-charged first electrode (31) and the positively-charged second electrode (32), the ionized dust can be captured by a coulomb force.

Most of dust in the air to be handled is removed after the air to be handled passes through the precipitator (30). However, some dust remains and moves toward the air outlet (12*b*) without being captured by the precipitator (30). The dust having passed through the precipitator (30) is captured by the adsorption member (15). The adsorption member (15) carries a deodorizing catalyst, too, and therefore, odorous components are decomposed at the adsorption member (15) as well.

Consequently, the air to be handled from which dust has been removed and in which odorous components have been decomposed is blown into a room through the air outlet (12*b*).

—Effects of First Embodiment—

According to the first embodiment, the charge section (20) adopts a diffusion charging technique, and the diffusion space (13*a*) is formed between the charge section (20) and the precipitator (30). Thus, ions generated between the discharge electrode (25) and the counter electrodes (26) of the charge section (20) are diffused in the diffusion space (13*a*) and combined with dust in the air to be handled, and thereby, the dust is charged. Dust and ions are mixed in the diffusion space (13*a*), which allows efficient charging of the dust, and therefore, sufficient capability for collection dust can be obtained. Further, dust is charged and collected in the device. Consequently, soiling of the walls of the room can be prevented.

Further, not only a diffusion charging technique, but also an impact charging technique are used. Thus, dust particles in the air, ranging from submicron-order to micron-order, can be charged and removed. This can prevent the situation in which the size of the dust particles which can be removed is limited to a certain size range.

—Variation of First Embodiment—

(First Variation)

Figure 4:
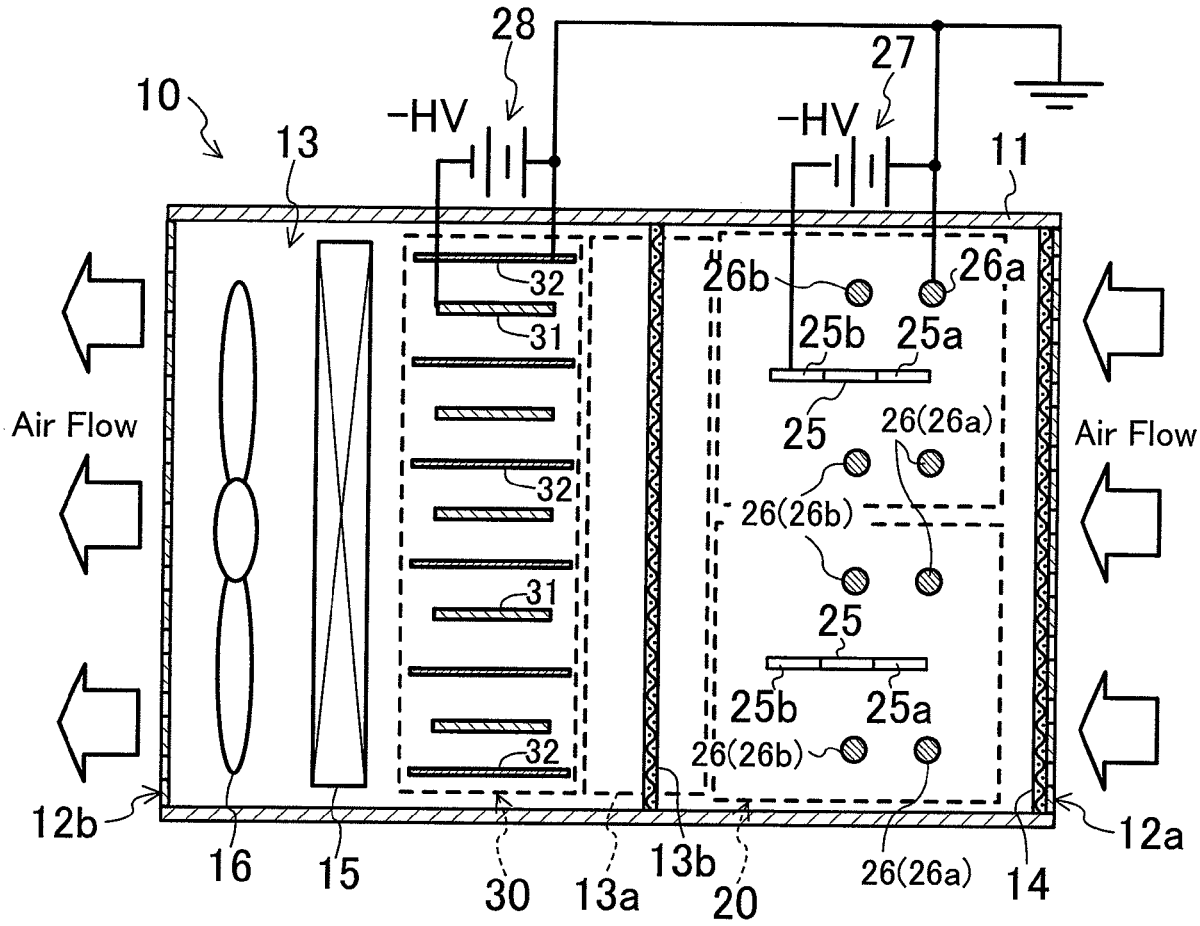
FIG. 4 shows a schematic cross-sectional view of an interior structure of an air cleaning device according to the first variation of the first embodiment.

In the air cleaning device (10) according to the first embodiment, a diffusion member (13*b*) for diffusing ions in the air may be provided in the diffusion space (13*a*), as shown in FIG. 4.

The diffusion member (13*b*) is constituted by a filter member (13*b*) having a lot of pores. The filter member (13*b*) has the function of diffusing ions in the air. Thus, the provision of the filter member (13*b*) in the diffusion space (13*a*) can increase the ion diffusion efficiency of the air cleaning device (10).

(Second Variation)

Figure 5:
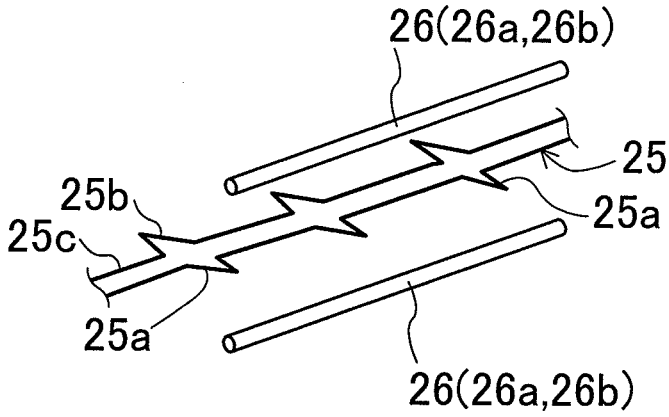
FIG. 5 is a view showing a charge section of the second variation of the first embodiment.

According to the second variation of the second embodiment, the counter electrode (26) of the first charge section (20*a*) and the counter electrode (26) of the second charge section (20*b*) are integrally formed with each other as shown in FIG. 5, in the structure using, as the discharge electrode (25), a sawtooth electrode (an integral discharge electrode (25)) which has an upstream discharge section (25*a*) (a first discharge section (25*a*)) constituting the first charge section (20*a*), and a downstream discharge section (25*b*) (a second discharge section 25*b*)) constituting the second charge section (20*b*). Specifically, the counter electrodes (26) are constituted by two rod-like electrodes (26) arranged one above the other to sandwich the sawtooth electrode in a vertical direction. The counter electrodes (26) are arranged parallel to the discharge electrode (25) along a vertically-extending phantom plane which passes through the tip, or an area closed to the tip of the upstream discharge section (25*a*). In this structure, the counter electrodes (26) are positioned at locations which are closer to the first discharge section (25*a*) than to the second discharge section (25*b*).

In this structure as well, the degree of curvature of the electric force lines between the discharge electrode (25) and counter electrodes (26) in the second charge section (20*b*) is larger than the degree of curvature of the electric force lines between the discharge electrode (25) and the counter electrodes (26) in the first charge section (20*a*). Therefore, impact charging occurs in the first charge section (20*a*), whereas diffusion charging occurs in the second charge section (20*b*).

Accordingly, the same effects as in the above-described embodiments can be obtained even if the structure described in this variation is utilized.

Figure 6:
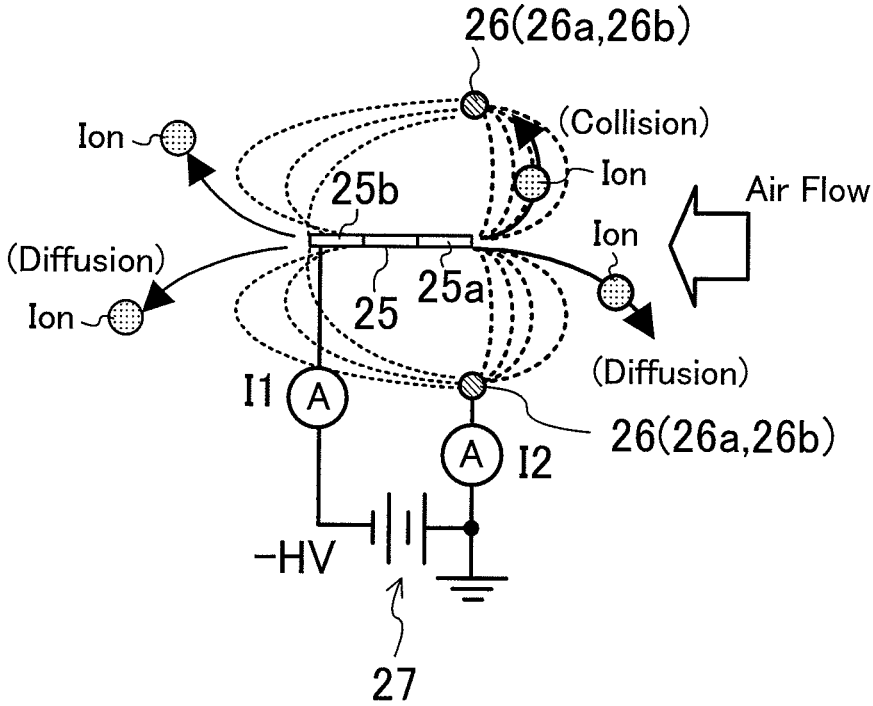
FIG. 6 shows an electric circuit diagram in which a power supply is connected to the charge section shown in FIG. 5.

In the second variation, a negative pole of a power supply (27) is connected to the discharge electrode (25), and a positive pole of the power supply (27) is connected to the counter electrodes (26) as shown in FIG. 6. The positive side of the power supply (27) is grounded.

Here, if the electric current flowing in the discharge electrode (25) is represented by "I1" and the electric current flowing in the counter electrodes (26) is represented by "I2," both the impact charging current (12) and the diffusion charging current (I1-I2) flow in the both electrodes. The ratio of components of the impact charging current and the diffusion charging current is set to $1 \leqq (I2)/(I1-I2) \leqq 20$.

Flow of both of the impact charging current and the diffusion charging current means that both of the impact charging and the diffusion charging occur. Setting the ratio of components of the impact charging current and the diffusion charging current to the above range enables efficient charging of the dust in the air.

(Third Variation)

Figure 7:
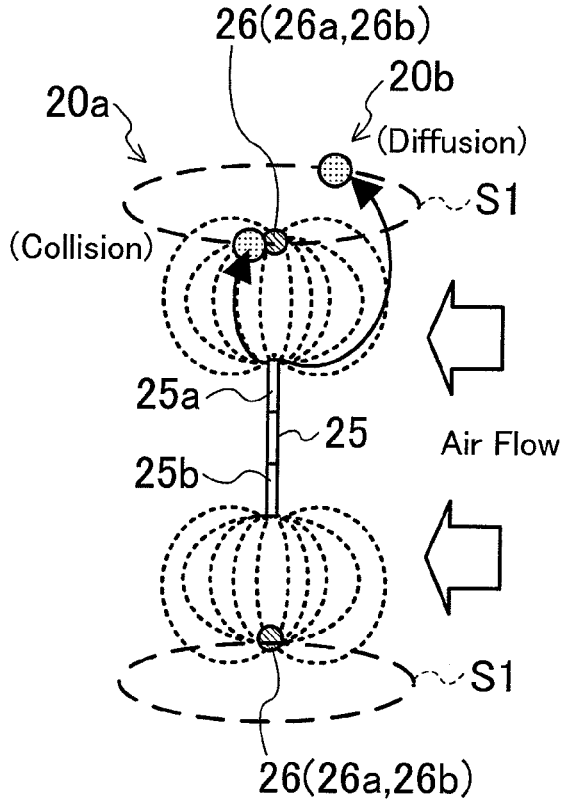
FIG. 7 shows a charge section of the third variation of the first embodiment.

According to the third variation, as shown in FIG. 7, two rod-like counter electrodes (26) are arranged one above the other so as to be parallel to each other, and the discharge electrode (25) (a sawtooth electrode) is placed between the counter electrodes (26), wherein the tip of each of the projections (25*a*, 25*b*) of the sawtooth electrode is oriented to the corresponding counter electrode (26). In this variation, the first charge section (20*a*) adopting an impact charging technique and the second charge section (20*b*) adopting a diffusion charging technique are formed between the discharge section (25*a*) located on the upper side and the corresponding counter electrodes (26), using only the discharge section (25*a*) and the counter electrode (26). Further, the first charge section (20*a*) adopting an impact charging technique and the second charge section (20*b*) adopting a diffusion charging technique are also formed between the discharge section (25*b*) located on the lower side and the corresponding counter electrode (26), using only the discharge section (25*b*) and the counter electrode (26). In the present embodiment, in order to form the first charge section (20*a*) and the second charge section (20*b*) by using only one counter electrode (26) for each discharge section (25*a*, 25*b*) as described above, space (S1) is provided in a region opposite to the discharge electrode (25) relative to the counter electrode (26).

In the above structure, the electric force lines generated between the discharge section (discharge electrode (25)) and each counter electrode (26) include electric force lines having a small degree of curvature which are generated between the discharge electrode (25) and each counter electrode (26), and electric force lines having a large degree of curvature which detour around the space between the discharge electrode (25) and the counter electrode (26) and reach behind the counter electrode (26).

Thus, discharge using an impact charging technique that is caused by a phenomenon in which ions are injected to the counter electrodes (26) along the electric force lines having a small degree of curvature, and discharge using a diffusion charging technique that is caused by a phenomenon in which ions moves away from the electric force lines having a large degree of curvature and are released in the air, occur between the above electrodes. Specifically, ions emitted from the discharge electrode (25) have the property of moving toward the counter electrodes (26) along the electric force lines. However, because the counter electrodes (26), i.e., targets of ions, are small and the air flow affects the movement of the ions, the ions moves away from the electric field and are released in the space (S1), thereby diffusion charging occurs. In addition, the strength of the electric field behind the counter electrode (26) relative to the discharge electrode (25) is low, and therefore, ions tend to escape into this space (S1).

The same effects as described in the above embodiments can be provided even if the structure described in this variation is utilized, because impact charging and diffusion charging occur as described above. In addition, the structure can be more simplified because the number of counter electrodes (26) can be less than the number of the counter electrodes (26) shown in FIGS. 2 and 3.

(Fourth Variation)

Figure 8:
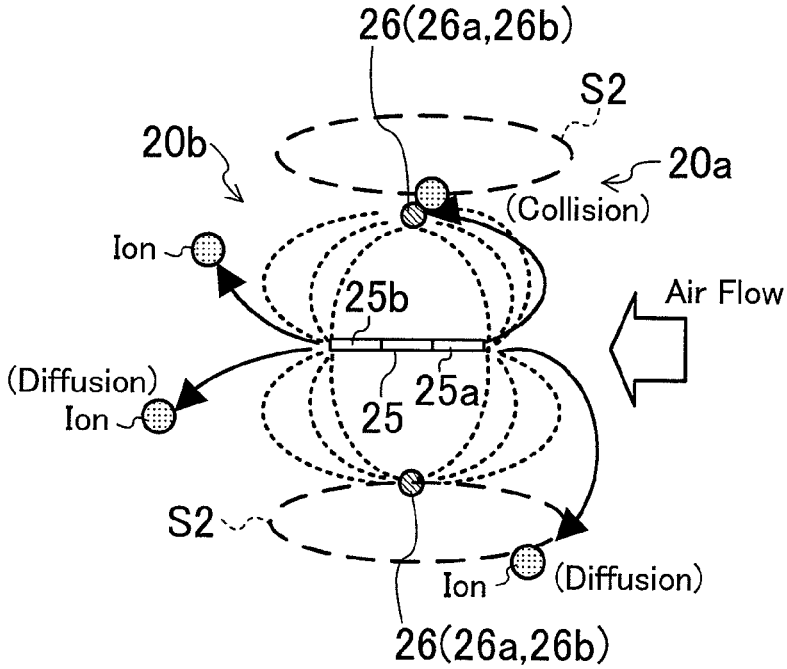
FIG. 8 shows a charge section of the fourth variation of the first embodiment.

According to the fourth variation, as shown in FIG. 8, two rod-like counter electrodes (26) are arranged one above the other so as to be parallel to each other, and the discharge electrode (25) (a sawtooth electrode) is placed between the counter electrodes (26), wherein the sawtooth electrode is arranged orthogonal to the phantom plane which passes through the two counter electrodes (26). In this variation, the first charge section (20*a*) adopting an impact charging technique and the second charge section (20*b*) adopting a diffusion charging technique are formed between the left and right discharge sections (25*a*, 25*b*) and the counter electrode (26) located above the discharge sections (25*a*, 25*b*), using only the discharge sections (25*a*, 25*b*) and the counter electrode (26). Further, the first charge section (20*a*) adopting an impact charging technique and the second charge section (20*b*) adopting a diffusion charging technique are formed also between the left and right discharge sections (25*a*, 25*b*) and the counter electrode (26) located below the discharge sections (25*a*, 25*b*), using only the discharge sections (25*a*, 25*b*) and the counter electrode (26). In the present embodiment, in order to form the first charge section (20*a*) and the second charge section (20*b*) by using only one counter electrode (26) for each discharge sections (25*a*, 25*b*) as described above, space (S1) is provided around the entire periphery of the counter electrode (26).

In the above structure, the electric force lines generated between the discharge sections (25*a*, 25*b*) (discharge electrode (25)) and each counter electrode (26) include electric force lines having a small degree of curvature which are generated between the discharge electrode (25) and each counter electrode (26), and electric force lines having a large degree of curvature which detour around the space between the discharge electrode (25) and the counter electrode (26) and reach behind the counter electrode (26).

Thus, discharge using an impact charging technique that is caused by a phenomenon in which ions are injected to the counter electrode (26) along the electric force lines having a small degree of curvature, and discharge using a diffusion charging technique that is caused by a phenomenon in which ions moves away from the electric force lines having a large degree of curvature and are released in the air, occur between the above electrodes.

The same effects as described in the above embodiments can be provided even if the structure described in this variation is utilized, because impact charging and diffusion charging occur as described above. In addition, the structure can be more simplified because the number of counter electrodes (26) can be less than the number of the counter electrodes (26) shown in FIGS. 2 and 3.

(Fifth Variation)

According to the fifth variation, the structure of the discharge electrode (25) differs from the structures of the discharge electrodes (25) shown in FIGS. 2 and 3.

Figure 9:
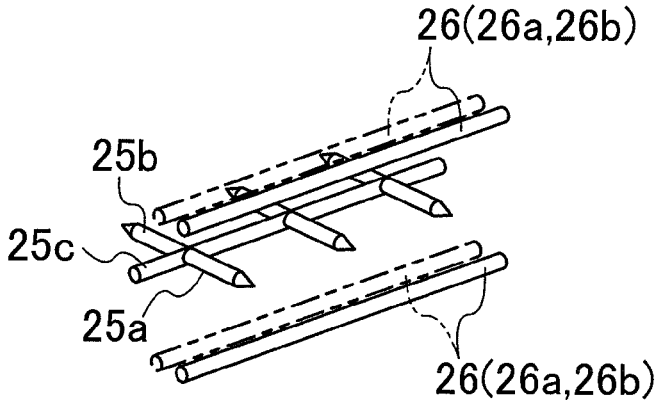
FIG. 9 shows a charge section of the fifth variation of the first embodiment.

Specifically, as shown in FIG. 9, the discharge electrode (25) includes a conductive, rod-like base plate portion (25*c*) and a plurality of sharp-tipped, needle-like discharge sections (25*a*, 25*b*) fixed to the rod-like base plate portion (25*c*). Each of the discharge sections (25*a*, 25*b*) is fixed to the rod-like base plate portion (25*c*) and projects out at a right angle. Further, each discharge section (25*a*, 25*b*) is constituted by a pair of discharge electrodes arranged in alignment with each other, and all the discharge sections (25*a*, 25*b*) are located along one phantom plane. In this example as well, the discharge section on the right side of the drawing is an upstream discharge section (25*a*), and the discharge section on the left side of the drawing is a downstream discharge section (25*b*).

Counter electrodes (26) are arranged one above the other, with the discharge electrode (25) interposed therebetween. The counter electrodes (26) are arranged along a plane which vertically passes through the tips of the upstream discharge sections (25*a*). The counter electrodes (26) are arranged parallel to each other at equal distances from the charge section (25*a*, 25*b*). Downstream counter electrodes (26*b*) shown in phantom line may be provided as the counter electrodes (26), such that the downstream counter electrodes (26*b*) are arranged one above the other, with the rod-like base portion (25*c*) of the discharge electrode (25) interposed therebetween, and are arranged parallel to the rod-like base portion (25*c*). These upper and lower downstream counter electrodes (26*b*) are arranged at equal distances from the rod-like base portion (25*c*) of the discharge electrode (25).

In this structure as well, electric force lines which are generated between the upstream discharge section (25*a*) and the counter electrodes (26) and which have a small degree of curvature, and electric force lines which are generated between the downstream discharge section (25*b*) and the counter electrodes (26) and which have a large degree of curvature, are formed between the discharge sections (25*a*, 25*b*) (a discharge electrode (25)) and the counter electrodes (26).

Thus, discharge using an impact charging technique that is caused by a phenomenon in which ions are injected to the counter electrode (26) along the electric force lines having a small degree of curvature, and discharge using a diffusion charging technique that is caused by a phenomenon in which ions moves away from the electric force lines having a large degree of curvature and are released in the air, occur between the above electrodes. Therefore, the same effects as described in the above embodiments can be provided even if the structure described in this variation is utilized.

<<Second Embodiment of Invention>>

The second embodiment of the present invention will be described.

Figure 10:
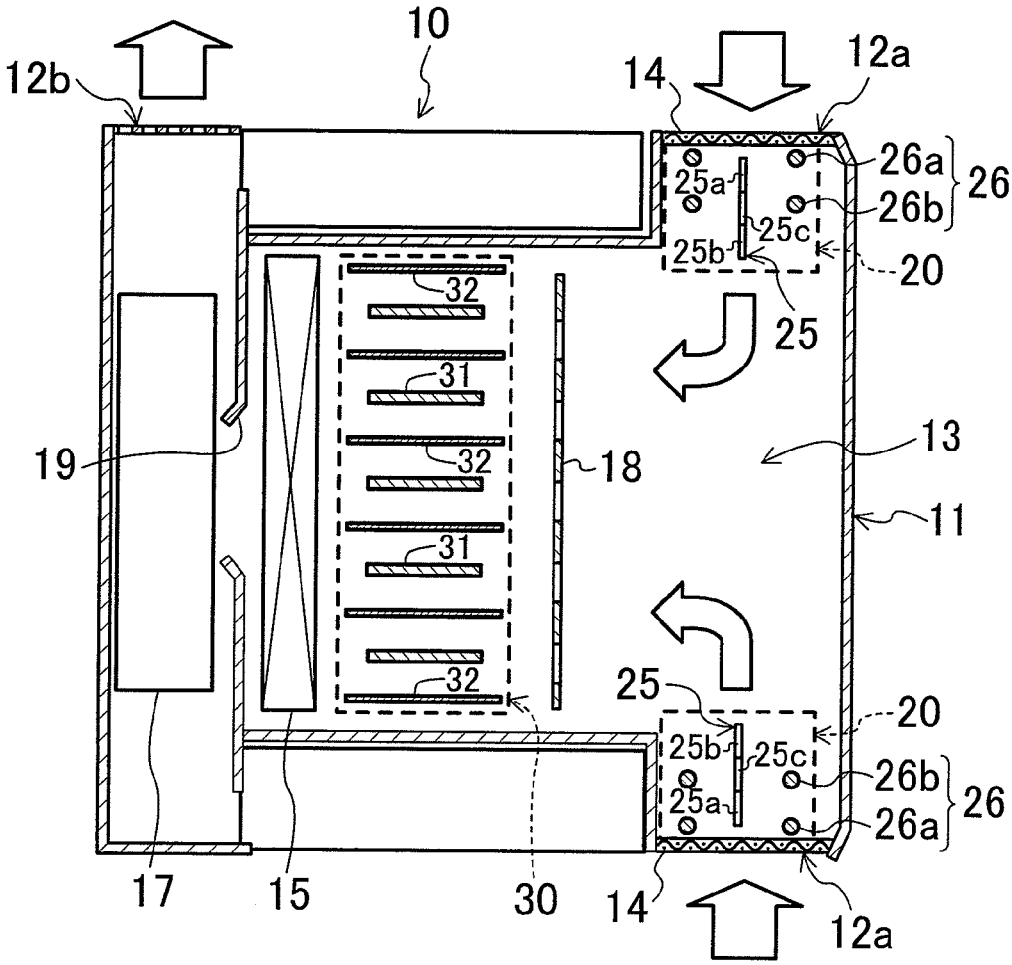
FIG. 10 shows a schematic cross-sectional view of an interior structure of an air cleaning device according to the second embodiment.

In the second embodiment, like the first embodiment, an air handling device according to the present invention is adopted in an air cleaning device (10). However, the structure of the device is different from the structure of the device described in the first embodiment. FIG. 10 is a schematic cross-sectional view of an interior structure of the air cleaning device (10).

The air cleaning device (10) includes a hollow casing (11), and a plurality of functional components are accommodated in the casing (11). The casing (11) is provided with air inlets (12*a*) at right end portions of the upper and lower (or left and right) walls as shown in the drawing, and an air outlet (12*b*) at a left end portion of one of the upper and lower (or left and right) walls as shown in the drawing. Each of the air inlets (12*a*) is provided with a pre-filter (14) for capturing relatively large dust (floating particles) contained in the air to be handled.

An air flow path (13) through which air flows from the air inlets (12*a*) to the air outlet (12*b*) is formed in the interior of the casing (11). A charge section (20), a precipitator (30), an adsorption member (15), and a centrifugal fan (a sirrocco fan) (17) are disposed in this order in the air flow path (13) from the upstream side to the downstream side of an air flow.

The air flow path (13) extends along the direction of air taken through the air inlets (12*a*) from the upper and lower (or left and right) sides of the casing (11), and is bent toward the air outlet (12*b*), and is further bent at the sirrocco fan (17) toward the air outlet (12*b*). A space is provided at a location between the charge section (20) and the precipitator (30) at which the air flow is bent, and this space is the diffusion space (13*a*) in which ions are diffused. If the air flow in the diffusion space (13*a*) flowing from the right side to the left side of the drawing is regarded as a main flow path, the air inlets (12*a*) are provided on sides of the main flow path of the diffusion space (13*a*).

The air cleaning device (10) has two charge sections (20) having the same structure and arranged one above the other (or on the left and right sides) so as to be in contact with the air inlets (12*a*). Each charge section (20) is constituted by a discharge electrode (25) and counter electrodes (26) like the charge sections shown in FIGS. 1-3 described in the first embodiment. The discharge electrode (25) is a strip-like electrode arranged parallel to the direction of the air flow, and includes triangular projections (25*a*, 25*b*) whose tip has an acute angle (the tip may be rounded with a small radius) and which are located at generally regular intervals along both edges of the discharge electrode (25). These projections (25*a*, 25*b*) form a discharge section. The discharge section (25*a*, 25*b*) includes an upstream discharge section (25*a*) located on the upstream side of an air flow, and a downstream discharge section (25*b*) located on the downstream side of an air flow.

The counter electrodes (26) are rod-like electrodes, and arranged such that the discharge electrode (25) is interposed between two pairs of counter electrodes located in the lateral side areas of the discharge electrode (25). Each pair of counter electrodes (26) includes a counter electrode (an upstream counter electrode) (26*a*) located on the upstream side of an air flow, and a counter electrode (a downstream counter electrode) (26*b*) located on the downstream side of the air flow. The upstream counter electrode (26*a*) is arranged parallel to the discharge electrode (25) along a vertically-extending phantom plane which passes through the tip, or an area close to the tip of the upstream discharge section (25*a*). Further, the downstream counter electrodes (26*b*) is arranged parallel to the discharge electrode (25) along a vertically-extending phantom plane which passes through a center line, or an area close to the center line of the discharge electrode (25).

The air flow path (13) is bent at a location (a diffusion space (13*a*)) through which the air to be handled flows after having passed through the charge section (20). A filter member (a diffusion member (13*b*)) is located on the upstream side of the precipitator (30) in the air flow path (13). Further, the precipitator (30) has the same structure as the structure of the precipitator (30) described in the first embodiment. An adsorption member (15) carrying an adsorption and a deodorizing catalyst is disposed on the downstream side of the precipitator (30) in the air flow path (13).

As a guiding member of an air flow to the sirrocco fan (17), a bell mouth (19) is located on the downstream side of the adsorption member (15). The sirrocco fan (17) changes the direction of the air guided to the sirrocco fan (17) through the bell mouth (19), and the air flows to the air outlet (12*b*) to be blown out of the casing (11) through the air outlet (12*b*).

In this embodiment, a power supply for the charge section (20) and the precipitator (30) are not shown in the drawings. However, a power supply is connected to each electrode in the same manner as described in the first embodiment. Further, the electrode to which a positive pole of the power supply is connected, is grounded as in the first embodiment.

—Operational Behavior—

When the air cleaning device (10) according to the present embodiment is actuated, the sirrocco fan (17) starts to rotate, and room air, i.e., air to be handled, is drawn into the casing (11) through the air inlet (12*a*). In the charge section (20), a potential difference is established between the discharge electrode (25) and the counter electrodes (26), and ions are emitted from the discharge electrode (25). Most of the ions emitted from the upstream discharge section (25*a*) of the discharge electrode (25) reach the upstream counter electrodes (26*a*), whereas most of the ions emitted from the downstream discharge section (25*b*) does not reach the downstream counter electrodes (26*b*) and is released in the air of the diffusion space (13*a*). Here, the ions are diffused more effectively owing to the bending of the air flow path (13).

Most of the ions emitted from the upstream discharge section (25*a*) reaches the counter electrodes (26), and are gathered at an area between the upstream discharge section (25*a*) and the upstream counter electrodes (26*a*). The relatively large dust of micron-order is charged when the air to be handled passes through this area. In contrast, most of the ions emitted from the downstream discharge section (25*b*) is released, and therefore dispersed, in the air of the diffusion space (13*a*). Thus, the relatively small dust of submicron-order is charged when the air to handled passes through the diffusion space (13*a*).

The air to be handled flows into the precipitator (30), with dust particles, ranging from small to large particle size, being charged. Since the precipitator (30) includes the positively-charged electrode plates and the negatively-charged electrode plates, the ionized dust is captured by a coulomb force.

Most of dust in the air to be handled is removed after the air to be handled passes through the precipitator (30). However, some dust remains and moves toward the air outlet (12*b*) without being captured by the precipitator (30). The dust having passed through the precipitator (30) is captured by the adsorption member (15). The adsorption member (15) carries a deodorizing catalyst, too, and therefore, odorous components are decomposed at the adsorption member (15) as well.

Consequently, the air to be handled from which dust has been removed and in which odorous components have been decomposed is blown into a room through the air outlet (12*b*).

—Effects of Second Embodiment—

In this embodiment, too, the charge section (20) adopts a diffusion charging technique, and the diffusion space (13*a*) is formed at a location between the charge section (20) and the precipitator (30) at which the air flow path (13) is bent. Thus, ions generated between the discharge electrode (25) and the counter electrodes (26) of the charge section (20) are diffused in the diffusion space (13*a*) and combined with dust in the air to be handled, and thereby, the dust is charged. Dust and ions are mixed in the diffusion space (13*a*), which allows efficient charging of the dust, and therefore, sufficient capabilities for collecting dust can be obtained. Further, dust is charged and collected in the device. Consequently, soiling of the walls of the room can be prevented.

Further, not only a diffusion charging technique, but also an impact charging technique are used. Thus, dust particles in the air, ranging from submicron-order to micron-order, can be charged and removed. This can prevent the situation in which the size of the dust particles which can be removed is limited to a certain size range.

—Variation of Second Embodiment—

Figure 11:
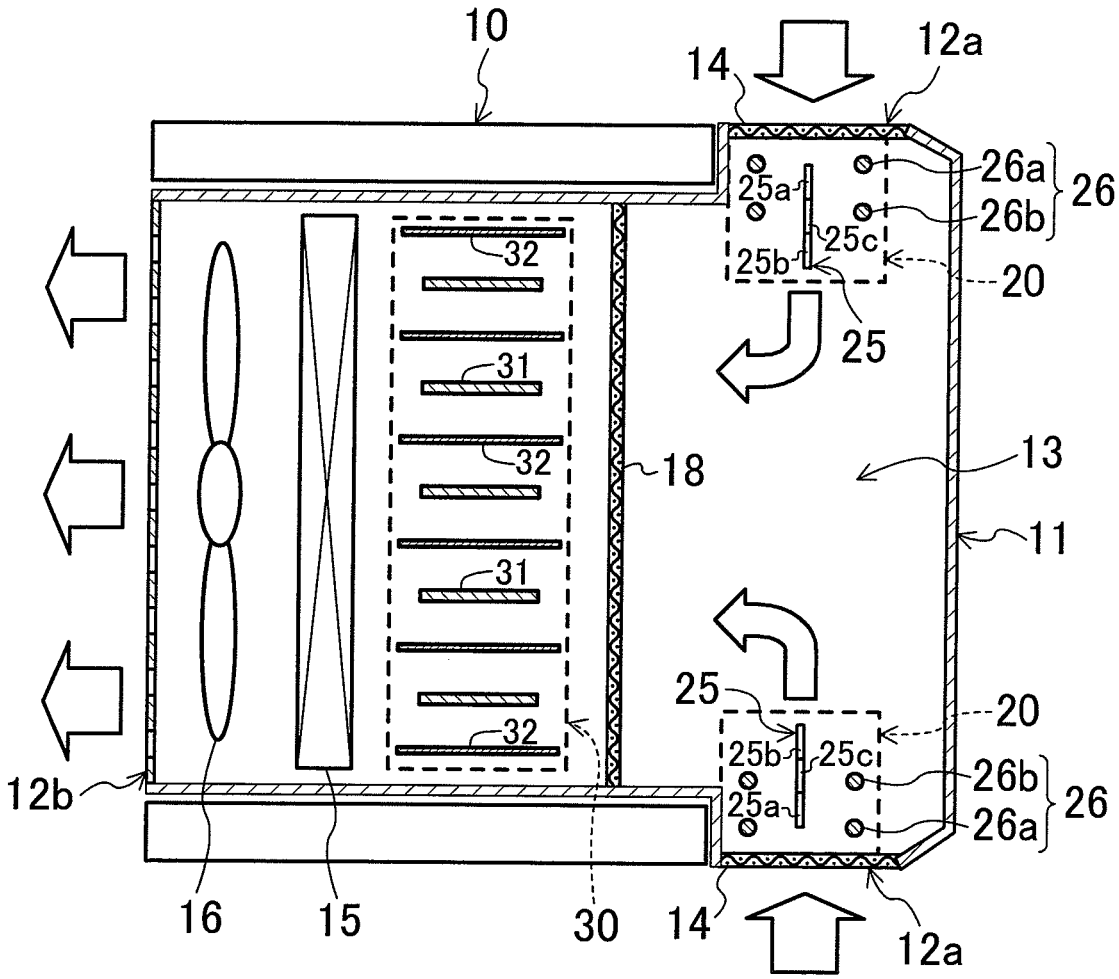
FIG. 11 shows a cross-sectional view of an air cleaning device according to a variation of the second embodiment.

The air cleaning device (10) of the second embodiment shown in FIG. 10 uses the sirrocco fan (17) for blowing out the purified air upward as shown in the drawing. However, the sirrocco fan (17) may be replaced with a propeller fan (16) as shown in FIG. 11. In this variation, the air outlet (12*b*) is located on the left side of the drawing in order that the room air drawn into the casing (11) from the upper and lower, or left and right sides of the casing (11) is purified by electrostatic precipitation and deodorizing catalysts, and is then blown into the room through the back side of the casing (11).

The other structures are the same as the structures shown in FIG. 10. Even if the structure is changed as described above, the same effects as the effects obtained in the second embodiment shown in FIG. 10 can be obtained.

<<Third Embodiment of Invention>>

The third embodiment of the present invention will be described.

Figure 12:
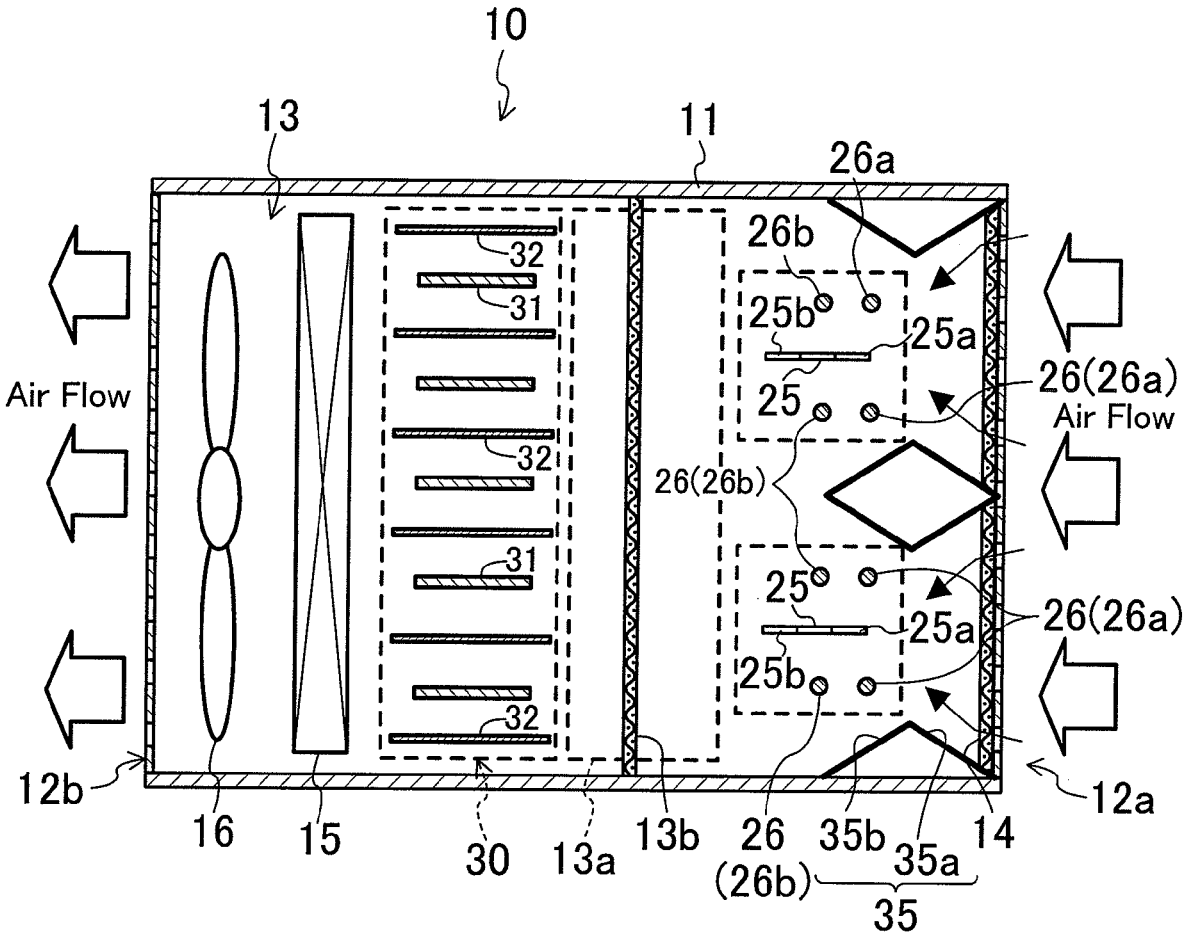
FIG. 12 shows a schematic cross-sectional view of an interior structure of an air cleaning device according to the third embodiment.

According to the third embodiment of the present invention, a flow path control member (35) is provided at the air inlet (12*a*), as shown in FIG. 12, in the variation of the first embodiment. The flow path control member (35) reduces the cross-sectional area of the flow path of the air flowing in the charge section (20), so that the airflow speed of the air to be handled which passes through the charge section (20)

becomes faster than the airflow speed of the air which passes through a main portion of the air flow path (13).

Specifically, the flow path control member (35) is configured such that the opening area of the air inlet (12*a*) in the air flow path (13) is smaller than the opening area of the main portion in the air flow path (13). The flow path control member (35) includes a guide plate (35*a*) which is inclined to reduce the cross-sectional area of the air flow path (13) as the air flow path (13) gets closer to the charge section (20) from the air inlet (12*a*). The flow path control member (35) further includes an inclined plate (35*b*) which is inclined in an opposite direction such that the cross-sectional area of the flow path increases as the flow path gets closer to the downstream side from the rear end of the guide plate (35*a*).

A diffusion space (13*a*) is provided on the downstream side of the charge section (20). A filter member as the diffusion member (13*b*) is placed in the diffusion space (13*a*). A precipitator (30), an adsorption member (15), and a propeller fan (16) are provided on the downstream side of the diffusion space (13*a*), as in the case of the structure shown in FIG. 1. An air outlet (12*b*) is provided on the left end of the casing (11) as shown in the drawing.

—Operational Behavior—

According to the third embodiment, when the air cleaning device (10) is actuated, a voltage is applied to the electrodes of the charge section (20) and the precipitator (30), and at the same time, the propeller fan (16) starts to rotate. The air of the room for which the air cleaning device (10) is installed is drawn in the casing (11) by the propeller fan (16). The air having been drawn in the casing (11) passes through the charge section (20) at a high speed, because the cross-sectional area of the air flow path is getting smaller from the air inlet (12*a*) to the charge section (20). Because the airflow speed is increased, the efficiency of diffusion of ions generated in the charge section (20) is enhanced, compared to the structures described in the first and second embodiments.

The airflow speed decreases after the air passes through the guide plate (35*a*), because the cross-sectional area of the flow path increases after the guide plate (35*a*). Dust collection capabilities of the precipitator (30) decrease if the airflow speed is high. However, according to the present embodiment, the air passes through the precipitator (30) at a low speed. Therefore, the dust collection capabilities do not decrease, and sufficient capabilities for collecting dust can be obtained.

Odorous components of the air having passed through the precipitator (30) are adsorbed by an adsorption contained in the adsorption member (15) located on the downstream side of the precipitator (30), and are decomposed by a deodorizing catalyst.

The purified air from which dust has been removed and in which odorous components have been decomposed as described above, is blown into a room through the air outlet (12*b*).

—Effects of Third Embodiment—

According to the third embodiment, too, the charge section (20) adopts a diffusion charging technique, and the diffusion space (13*a*) is formed between the charge section (20) and the precipitator (30). Thus, ions generated between the discharge electrode (25) and the counter electrodes (26) of the charge section (20) are diffused in the diffusion space (13*a*) and combined with dust in the air to be handled, and thereby, the dust is charged. Dust and ions are mixed in the diffusion space (13*a*), which allows efficient charging of the dust, and therefore, sufficient capabilities for collecting dust can be obtained. Further, dust is charged and collected in the device. Consequently, soiling of the walls of the room can be prevented.

Further, the airflow speed of the air which passes through the charge section (20) is increased by the flow path control member (35), and therefore, diffusion efficiency can be enhanced. In addition, the flow path control member (35) is configured such that the airflow speed decreases after the air passes through the charge section (20). Thus, a reduction in dust collection efficiency of the precipitator (30) can be prevented.

Further, not only a diffusion charging technique, but also an impact charging technique are used. Thus, dust particles in the air, ranging from submicron-order to micron-order, can be charged and removed. This can prevent the situation in which the size of the dust particles which can be removed is limited to a certain size range.

<<Other Embodiments>>

The present invention may have the following structures in the above embodiments.

For example, the charge section (20) of the above embodiments adopts not only the diffusion charging technique, but also the impact charging technique. However, the charge section (20) may adopt only the diffusion charging technique, and may not adopt the impact charging technique.

Figure 13:
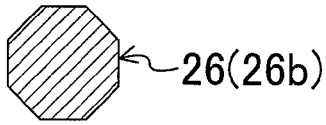
FIG. 13 shows a cross-sectional view of a variation of a counter electrode.

Further, in the above embodiments, a rod-like electrode or a rod-like electrode having a circular cross section is used as a counter electrode of the second charge section (20*b*). However, an electrode having a polygonal cross section and obtuse-angled corners may be used as the counter electrode as shown in FIG. 13. In this case, it is preferable that the diagonal dimension or the diameter of the counter electrode of the second charge section is one fifth or less of the distance (D) between the discharge electrode and the counter electrode, and is greater than zero (mm).

Further, the precipitator (30) is not limited to a structure using an electrode plate or the like, but may be a structure using an electrostatic filter. Moreover, the polarities of the electrodes of the charge section (20) and the precipitator (30) are not limited to the polarities described in the above embodiments, but may be reversed, for example.

The foregoing embodiments are merely preferred examples in nature, and are not intended to limit the scope, applications, and use of the invention.

Industrial Applicability

As described above, the present invention is useful as air handling devices adopting a diffusion charging technique in which ions generated by a charge section are dispersed in the air.

The invention claimed is:

1. An air handling device having an air flow path in which a charge section for charging dust in an air to be handled, and a precipitator for collecting the charged dust are placed, wherein the charge section includes a discharge electrode and a counter electrode to perform diffusion charging, a diffusion space is provided at a location between the charge section and the precipitator, a first charge section adopting an impact charging technique is positioned on an upstream side of a direction of the air to be handled, and a second charge section adopting a diffusion charging technique is positioned on a downstream side of the direction of the air to be handled, a discharge electrode of the first charge section and a discharge electrode of the second charge section are constituted by an integral discharge electrode, and a counter electrode of the first charge section is located on the air flow upstream side, and a counter electrode of the second charge section is located on the air flow downstream side, relative to the discharge electrode.

2. The air handling device of claim 1, wherein a diffusion member for diffusing ions in an air is provided in the diffusion space.

3. The air handling device of claim 1, wherein a bent path is provided in a space through which the air flows after having passed the charge section and before passing through the precipitator.

4. The air handling device of claim 1, wherein an airflow speed of the air to be handled is higher when the air passes through the charge section than when the air passes through a main portion of the air flow path.

5. The air handling device of claim 4, comprising:

a flow path control member which makes the airflow speed of the air to be handled higher when the air passes through the charge section than when the air passes through the main portion of the air flow path.

6. The air handling device of claim 4, wherein an opening area of an air inlet of the air flow path is smaller than an opening area of the main portion of the air flow path, and the charge section is provided at the air inlet.

7. The air handling device of claim 1, wherein an air inlet of the air flow path is provided in a side face of the air flow path.

8. The air handling device of claim 1, wherein the precipitator is a member which electrostatically collects dust.

9. The air handling device of claim 1, wherein if an electric current flowing in the discharge electrode is represented by I1 and an electric current flowing in the counter electrode is represented by I2, a diffusion charging current (I1-I2) flows in both of the electrodes.

10. The air handling device of claim 1, wherein the discharge electrode is a needle-shaped electrode.

11. The air handling device of claim 1, wherein the discharge electrode is a sawtooth electrode.

12. The air handling device of claim 10 or claim 11, wherein the counter electrode is positioned at a location shifted from a discharge direction of the discharge electrode.

13. The air handling device claim 1, wherein the integral discharge electrode includes a first discharge section which constitutes the discharge electrode of the first charge section, and a second discharge section which constitutes the discharge electrode of the second charge section, and the counter electrode of the first charge section and the counter electrode of the second charge section are constituted by an integral counter electrode, and the integral counter electrode is located closer to the first discharge section than to the second discharge section.

14. The air handling device of claim 1, wherein the counter electrode of the charge section which performs diffusion charging is a rod-shaped electrode having a polygonal cross section and obtuse-angled corners.

15. The air handling device of claim 1, wherein the counter electrode of the charge section which performs diffusion charging is a rod-shaped electrode having a circular cross section.

16. The air handling device of claim 14 or claim 15, wherein a diagonal dimension or a diameter of the counter electrode of the charge section which performs diffusion charging is one fifth or less of a distance between the discharge electrode and the counter electrode, and is greater than zero.

17. The air handling device of claim 14, wherein a space is provided in a region opposite to the discharge electrode, relative to the counter electrode of the charge section which performs diffusion charging.

18. The air handling device of claim 14, wherein a space is provided around an entire periphery of the counter electrode of the charge section which performs diffusion charging.

19. The air handling device of claim 17 or claim 18, wherein the counter electrode of the charge section which performs diffusion charging is located in an air flow path along which the air to be handled flows.

* * * * *